US005275528A

United States Patent [19]

Freeman et al.

[11] Patent Number: 5,275,528

[45] Date of Patent: Jan. 4, 1994

[54] FLOW CONTROL METHOD AND MEANS

[75] Inventors: Christopher Freeman, Farnsfield; Ivor J. Day, Cambridge, both of England

[73] Assignee: Rolls-Royce plc, London, United Kingdom

[21] Appl. No.: 573,821

[22] Filed: Aug. 28, 1990

[51] Int. Cl.[5] ..... F01D 17/08

[52] U.S. Cl. ..... 415/1; 415/26; 415/47; 415/51; 415/58.5; 415/116; 415/118; 415/119; 60/39.091; 60/39.29

[58] Field of Search ..... 415/1, 17, 26–; 60/39.091, 39.29

[56] References Cited

U.S. PATENT DOCUMENTS 4,196,472 4/1980 Ludwig et al. .
4,255,083 3/1981 Andre et al. ..... 415/119

FOREIGN PATENT DOCUMENTS 3623696 1/1988 Fed. Rep. of Germany .
1136881 5/1957 France .
2248427 5/1975 France .
792343 3/1958 United Kingdom .
1481031 7/1977 United Kingdom .
2191606 12/1987 United Kingdom .

OTHER PUBLICATIONS

"Tests of an Improved Rotating Stall Control System on a J-85 Turbojet Engine", G. R. Ludwig, AFAPL--TR-79-2060 Air Force Aero-Propulsion Laboratory, Wright-Patterson AFB, Ohio, Aug. 1979.

"Presentation to the Workshop on Applications of Active Control to Engineering Systems", I. J. Day, Cambridge, U.K. Jun. 1990.

*Primary Examiner*—Edward K. Look
*Assistant Examiner*—Christopher Verdier
*Attorney, Agent, or Firm*—Oliff & Berridge

[57] ABSTRACT

The invention provides a method of controlling gas flow in an axial flow compressor, in which the flow at least at one chosen station in the direction of flow through the compressor is sensed at a series of circumferentially spaced positions. Flow variations above a predetermined limit are evaluated to give an actuating response if the variations indicate a disturbance above a predetermined acceptable level is present. When such a disturbance is detected, high pressure flow bled from the exit end of the compressor is injected at said station to supplement the main gas flow there. An incipient rotating stall cell will appear as a variation occurring sequentially at the circumferentially spaced positions. By responding to such a condition with a pressure injection flow, it is found possible to suppress both rotating stall and surge conditions in the compressor before the disturbance develops fully.

18 Claims, 14 Drawing Sheets

TIME TRACES FROM SIX HOTWIRES SHOWING THE EMERGENCE AND DEVELOPMENT OF THE FIRST STALL CELL

TIME TRACES FROM SIX HOTWIRES SHOWING THE DEVELOPMENT OF A STALL CELL PRIOR TO A PERIOD OF REVERSED FLOW DURING A SURGE CYCLE

TIME TRACES FROM SIX HOTWIRES DURING A REPEATED SURGE CYCLE

TIME TRACES FROM FOUR HOTWIRES SHOWING THE INITIAL DEVELOPMENT OF A STALL CELL WHICH WAS SUBSEQUENTLY ELIMINATED BY THE ACTION OF THE AIR INJECTION VALVES (TOP TRACE)

TIME TRACES FROM FOUR HOTWIRES SHOWING THE INITIATION OF ROTATING STALL. THE TOP TRACE SHOWS THE CONTROL SIGNAL FOR OPENING THE AIR INJECTION VALVES (NOT OPERATIVE IN THIS CASE)

TIME TRACES FROM FOUR HOTWIRES SHOWING THE EFFECTIVE ACTION OF THE CONTROL SYSTEM (LHS OF DIAGRAM) AND THE RESULTING ROTATING STALL WHEN THE CONTROL SYSTEM IS SWITCHED OFF (RHS OF DIAGRAM)

TIME TRACES FROM 6 PIEZO-ELECTRIC PROBES SHOWING THE REPEATED FORMATION OF STALL CELLS WHICH ARE IMMEDIATELY ELIMINATED BY THE ACTION OF THE CONTROL VALVES

Figure 9:
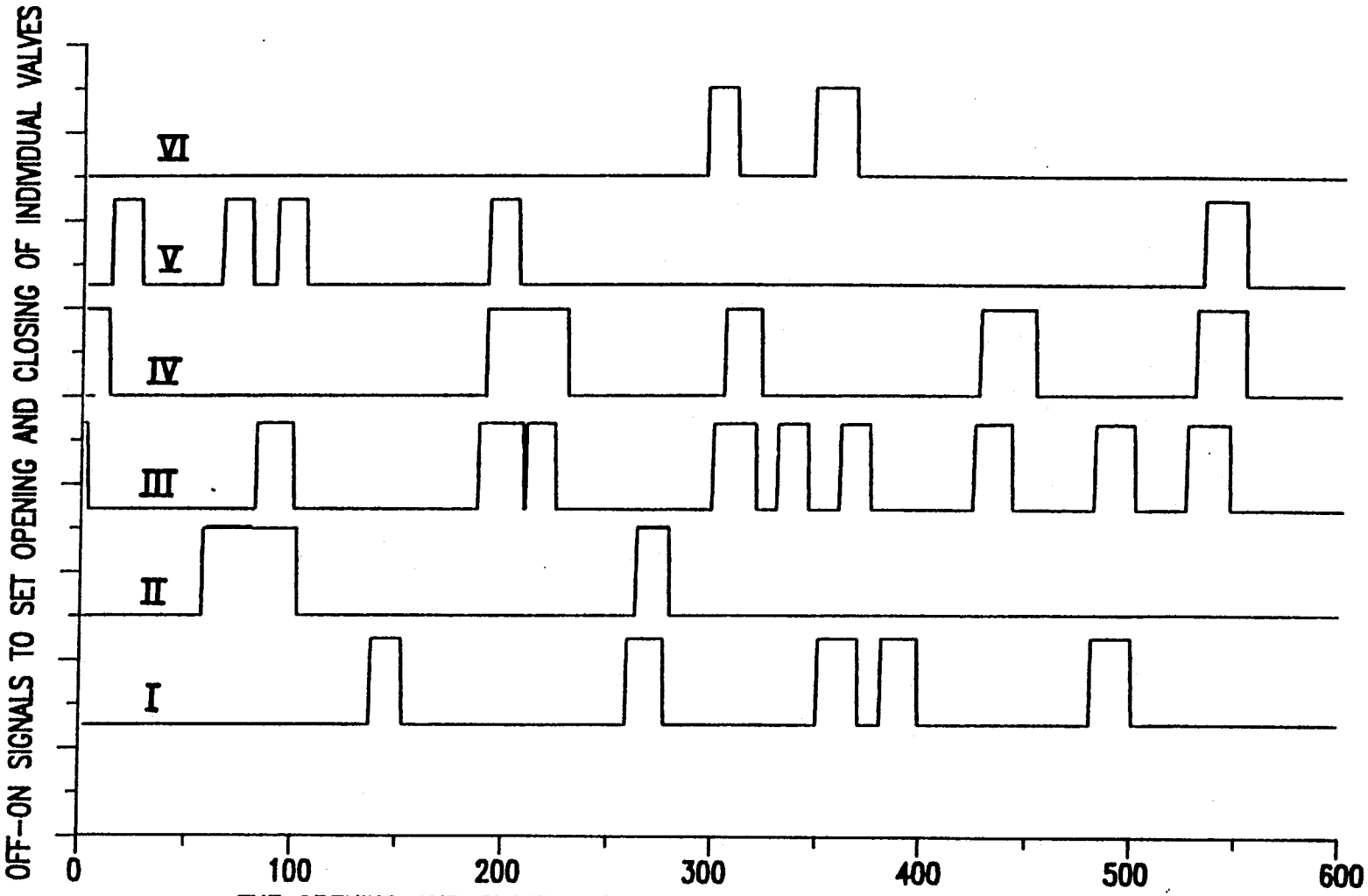

THE OPENING AND CLOSING SEQUENCE OF THE CONTROL VALVES USED TO ELIMINATE THE EMERGING STALL CELLS SHOWN IN FIGURE 9

DIAGRAM SHOWING TYPICAL PLENUM PRESSURE AND HOTWIRE SIGNALS DURING A COMPLETE SURGE CYCLE

OUTPUT FROM SINGLE HOTWIRE (AHEAD OF FIRST ROTOR) SHOWING TWO COMPLETE SURGE CYCLES BEFORE CONTROLLER IS SWITCHED ON FOR 10 SECONDS. AFTER CONTROLLER IS SWITCHED OFF SURGING IS IMMEDIATELY RESUMED

PRESSURE RISE CHARACTERISTIC SHOWING RANGE OF OPERATION EXTENDED BY CONTROL SYSTEM

FLOW CONTROL METHOD AND MEANS

This invention relates to a method of and means for the control of the phenomena of rotating stall and surge in turbo-compressors, in particular axial turbo-compressors.

Rotating stall is an aerodynamic instability which determines the peak of the pressure rise capabilities of a turbo-compressor. At that peak any further demand will lead to the formation of a small patch (usually referred to as a "cell") of disturbed flow in the blading which can then spread rapidly to engulf a large proportion of the annular cross-section of the compressor. As the stall cell forms fully, the delivery pressure at the exit from the compressor falls off just as rapidly. This type of disturbance is called rotating stall because the disturbed or "blocked" sector of the annulus will rotate with the blading, at roughly half the speed (typically between 0.8 and 0.3).

The system-related instability of surge occurs when a compressor is coupled to a large downstream volume, e.g. pipework in an industrial plant or the combustion chamber in a gas turbine. If the pressure rise capability of the compressor is exceeded and a stall condition is initiated there is a fall in delivery pressure which allows compressed gas in the volume downstream of the compressor to blow back through the compressor. In extreme cases this can lead to flames spewing out of the front of an engine. Venting the downstream volume in this way lowers the back pressure on the compressor; the stall condition disappears and the pressure downstream is able to rise again as the downstream volume is refilled. The stalling, venting, refilling cycle will thus start again and a continuous sequence of surge cycles can ensue if the operating conditions remain unchanged.

Both stall and surge will limit the operating range of a machine and are damaging conditions. Rotating stall leads to very high temperatures in the compressor and surge to violent bending loads on the blading. The accepted way of avoiding these dangers has been to ensure the compressor does not work close to its peak pressure rise. In recent times, however, it has been suggested that active control techniques might be employed to improve performance. Reference can be made to GB 2191606A and to Epstein AH, Ffowcs-Williams JE, and Greitzer EM, "Active Suppression of Aerodynamic Instabilities in Turbomachinery", AIAA *Journal of Propulsion and Power,* Vol 5, No 2 1989.

In U.S. Pat. No. 4,196,472 (Ludwig et al) a stall control system for an axial flow compressor is disclosed in which signals from a number of pressure transducers within the compressor are compared with a reference signal, the value of which is related to the operating conditions in the compressor. The signals from the individual transducers are compared sequentially with the reference signal so that corrective action can be initiated when an abnormal value is sensed by any one sensor. The signals are also summed, and the strength of the corrective action is determined by the summed signal value The form of corrective action described in U.S. Pat. No. 4,196,472 takes the form of a controllable bleed from the compressor gas passage, and control of the stagger angle of the stator blades is also suggested.

In the present invention, a novel manner of controlling rotating stall and surge in turbo-compressors is provided, in which variations in the flow are sensed at a series of circumferentially spaced positions at a chosen station in the direction of flow through the compressor to detect variations above a predetermined variation limit.

In accordance with one aspect of the invention, upon such a variation being detected, a flow of higher-pressure gas from a first region at or adjacent the exit of the compressor is injected into a region upstream of the first region, said injection being directed generally in said direction of flow, to act against a flow disturbance indicated by said variation According to another aspect of the invention, the sensing of said variations at a series of said positions in circumferential sequence actuates the injection of a flow of gas at a higher pressure than that prevailing at said station to act against a flow disturbance indicated by said variations.

A significant feature of the present invention, the use of injected gas to counter a flow disturbance, has the advantage over the method proposed by U.S. Pat. No. 4,196,472 that the injection of gas improves the basic surge margin of the compressor. The compressor is therefore capable of operating at a higher output than would be the case with a prior art bleed system.

It is possible within the scope of the invention to employ any desired pattern of gas injection. For example, in response to the sensing of a rotating flow variation gas may be injected sequentially through a circumferentially spaced series of ports at a station. Alternatively, gas may be injected simultaneously through said series of ports. Gas injection means may be provided at a number of axially spaced stations to be actuated in response to sensed variations at their respective stations or at other stations as appropriate. When the control system is deployed at a number of axial stations, it may be operated independently at each station or the gas injection at the different stations can be coordinated, e.g. to operate in unison or in a predetermined sequence.

In principle any axial region may be chosen for the flow injection, it only being necessary to ensure that the injection pressure is sufficient to ensure that an adequate energy input is achieved at a location when it will influence the flow disturbance sensed. It may be sufficient, therefore, to provide the sensing and injection means at a single axial station but, as already indicated, the provision of such means at a number of stations is not precluded. The critical axial station or stations at which a flow disturbance will be initiated can be expected to vary with different designs of turbo-compressors and the locations of the injection and sensing means may therefore be selected empirically. There may also be a need to monitor the compressor flow near its outlet end for incipient surge conditions, independently of monitoring for rotating stall further upstream.

According to a further aspect of the invention, apparatus having means for sensing variations in the flow at a series of circumferentially spaced positions at a chosen station in the direction of flow through a turbo-compressor comprises means for tapping higher pressure gas from a region at or adjacent the exit of the compressor, means for reinjecting said higher pressure gas into the compressor at said chosen station, generally in said direction of flow, and control means for permitting said injection to take place, said control means being operable by said detection means upon detection of said flow variations above a predetermined variation limit.

In yet another aspect of the invention, apparatus having flow sensing means for a series of circumferentially spaced positions at a chosen station in the direction of flow through a turbo-compressor comprises means for detecting, from signals from the sensing means at the individual positions, flow variations above a predetermined limit, means for injecting a flow of gas at a higher pressure than that prevailing at said station and generally in the direction of flow, means for actuating said injection means in response to the sensing of said variations at a series of said positions in circumferential sequence thereby to act against a flow disturbance indicated by said variations.

It is generally desirable to provide a series of circumferentially spaced ports for the injection flow at the or each axial region. Preferably the flows through such a series of ports are controlled by respective valves for individual ports or circumferentially sequential groups of ports. The outlets should direct their flows towards the high-pressure end of the compressor, preferably in an oblique direction that opposes the direction of rotation of the compressor.

In a preferred method of operation, when an injection flow is triggered, the or each valve controlling the flow is automatically re-shut after an interval, which may be a preset period, since a continuous injection of high-pressure gas would be uneconomic. It is preferred to do this by tapering off the initial flow whereby the flow control effect is removed gradually. This is particularly applicable when a relatively lengthy period of injection flow is needed to influence the disturbance; should the disturbance appear again before the flow has been shut off, the rate of flow can be increased again to its initial value. With repeated tapering and restoration of the flow, it is ensured that the flow is kept to the minimum to control the disturbance and is cut off as the cause of the disturbance disappears. Moreover, a timed tapering of the injection flow is able to limit the energy input for operating the corrective system without impairing its efficiency.

It is significant that the invention can be utilised, e.g. in the mode of operation just described, without the control means needing a feedback loop. It is possible to initiate corrective action at a maximum rate when gas injection begins, subject only to the threshold disturbance level having been exceeded. If thereafter the rate of injection is tapered off it can be assured that full corrective action is restored at any stage if the disturbance continues or restarts, but in particular flow systems an on-off characteristic may be equally effective. The arrangement permits considerable simplification, as compared with prior art arrangements, without impairing the ability to control disturbances.

In a preferred control arrangement according to the invention, each sensor signal is averaged over a period not substantially less than two revolutions of the compressor to give a mean value, a difference signal is then formed between the instantaneous and mean signals, a measure of the relative magnitude of the difference signal is obtained, and the detection of signal relative magnitudes above a predetermined level from a plurality of the sensors is arranged to produce an operative output for actuating the injection means. Such an arrangement can be employed to actuate the injection means in a sequential pattern.

In the application of this arrangement, sequential operative outputs from all or some of the sensors at a particular axial station would indicate rotating stall, while simultaneous signals from all or some of said sensors would indicate a surge condition. In either case a gas injection process would be initiated appropriate to the type of disturbance sensed. That is to say, a stall condition would be countered by circumferentially sequential injections of gas, whereas all the injection ports would be opened simultaneously for a surge condition. When responding to a circumferential sequence of operative outputs from the sensors, it may be found appropriate to actuate the sequential gas injection at a different phase for optimum results.

If there are sensors at a number of spaced axial stations, it is also possible to coordinate the signals from different stations so that, for example, gas injection is triggered if a number of sensors at different stations but with similar circumferential positions, give an operative signal. In this way the control arrangement can also be used to limit disturbances due to other reasons, such as transient manoeuvres of the aircraft in the case of an aero engine.

It may also be found useful for an operative signal at one station to actuate an injection flow of another station, for example, if a flow disturbance is more easily detected at a station downstream from its initiation. Thus, at higher speeds rotating stall may first show itself nearer the compressor outlet.

Figure 1:
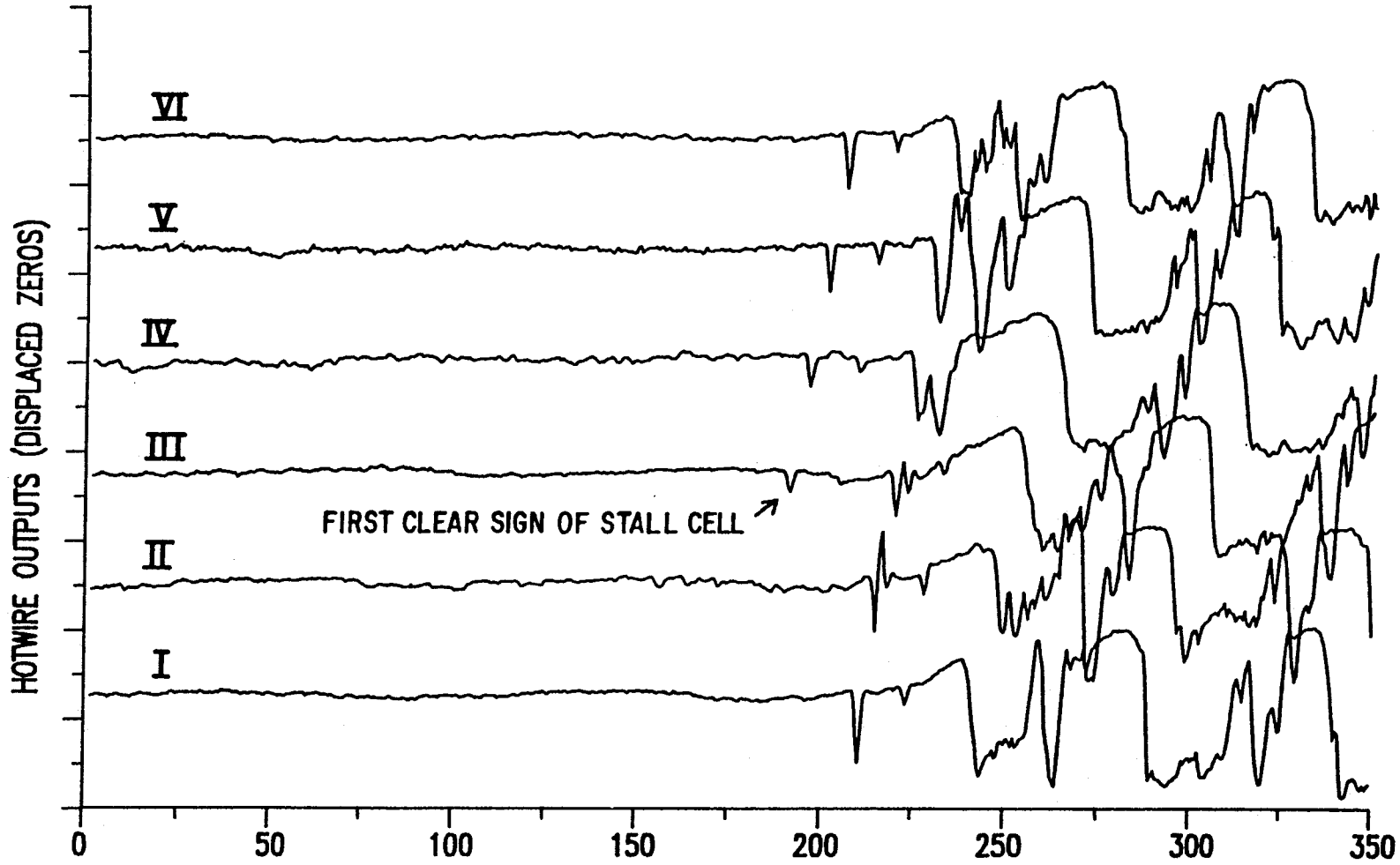
Figure 2:
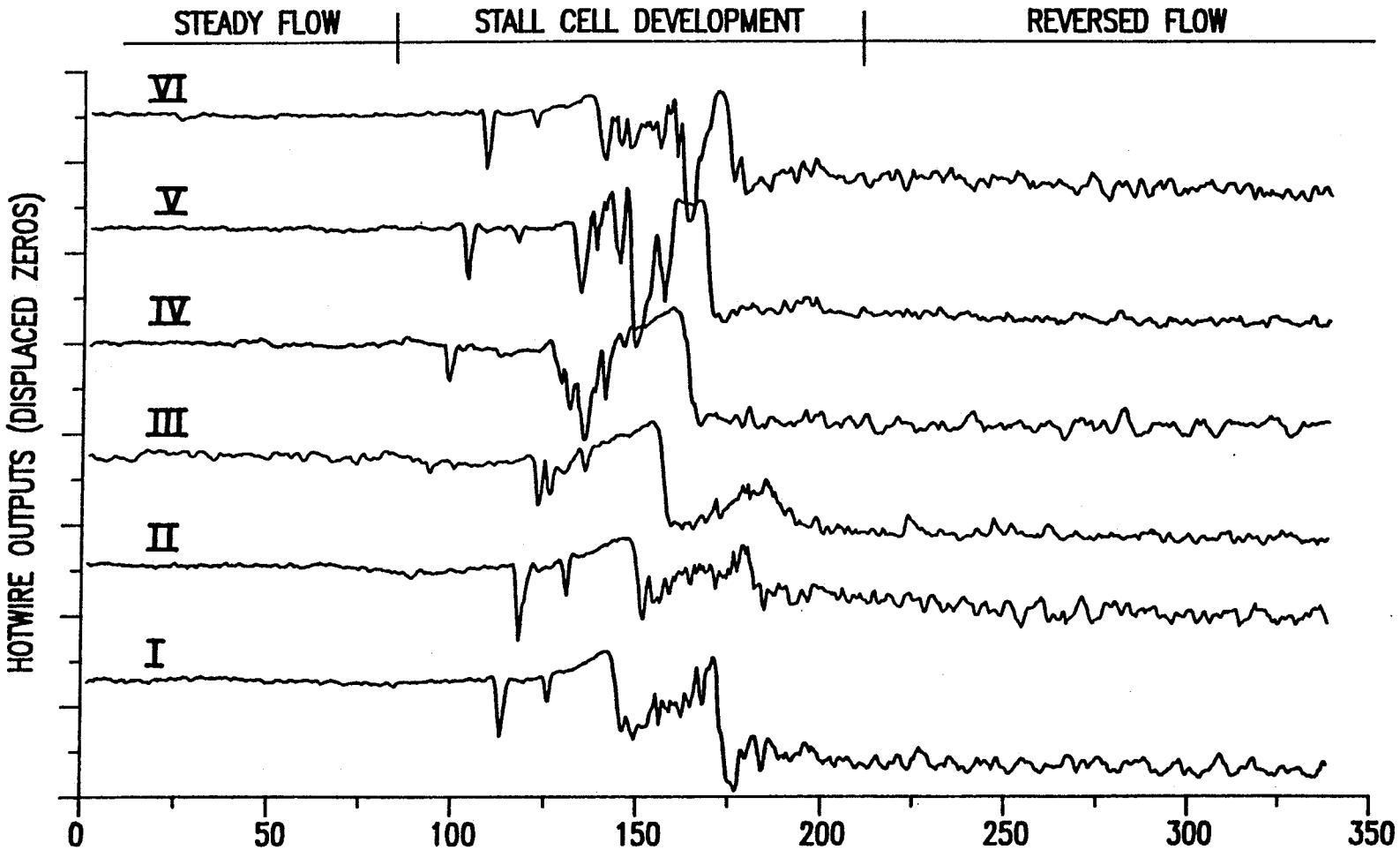
Figure 3:
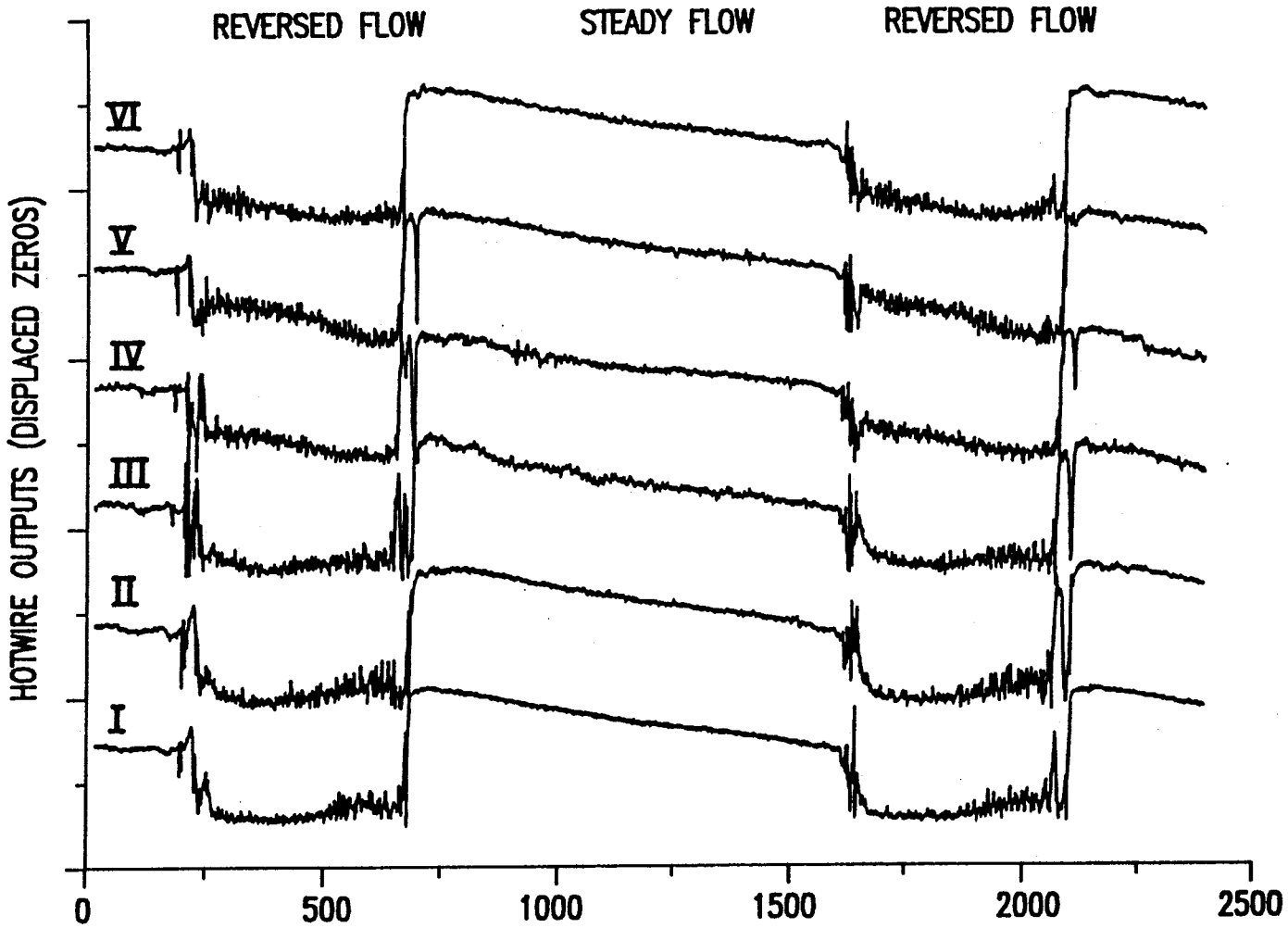
Figure 4:
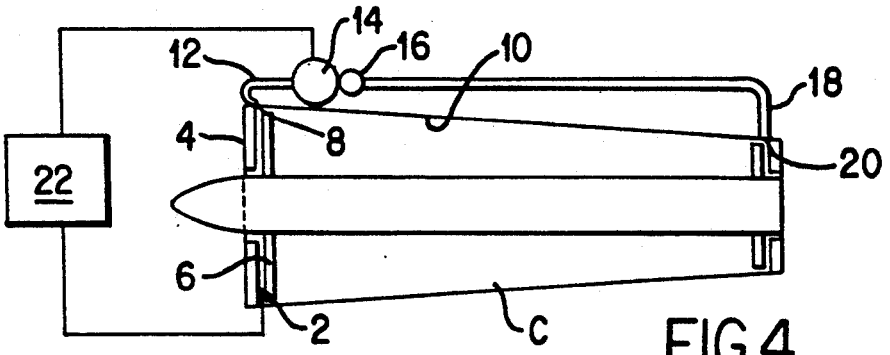
Figure 13A:
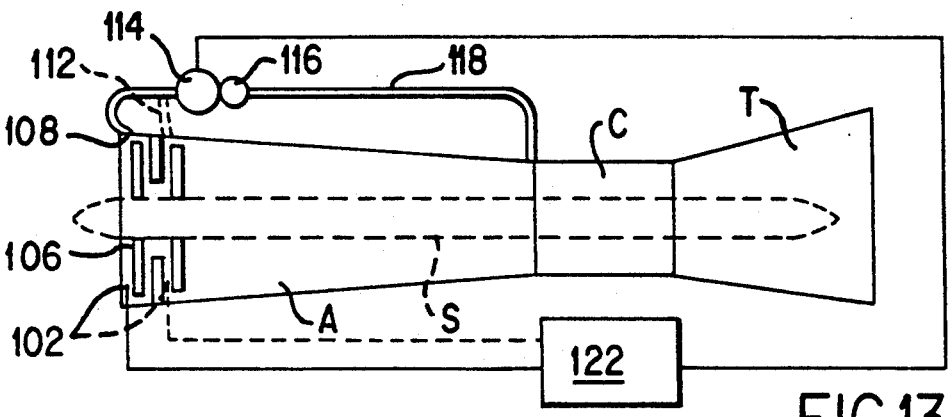
Figure 15:
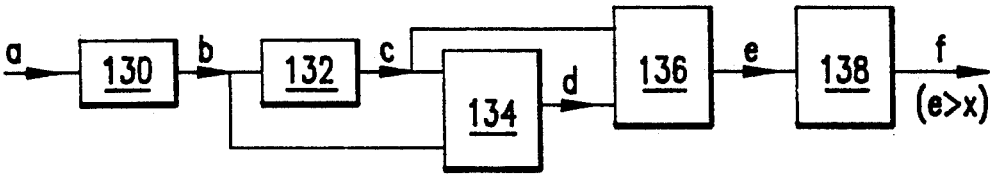
Figure 16:
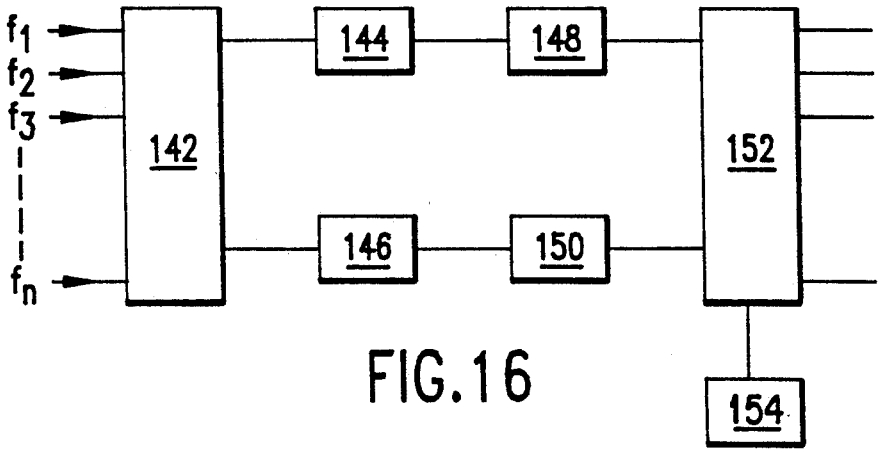
Figure 10:
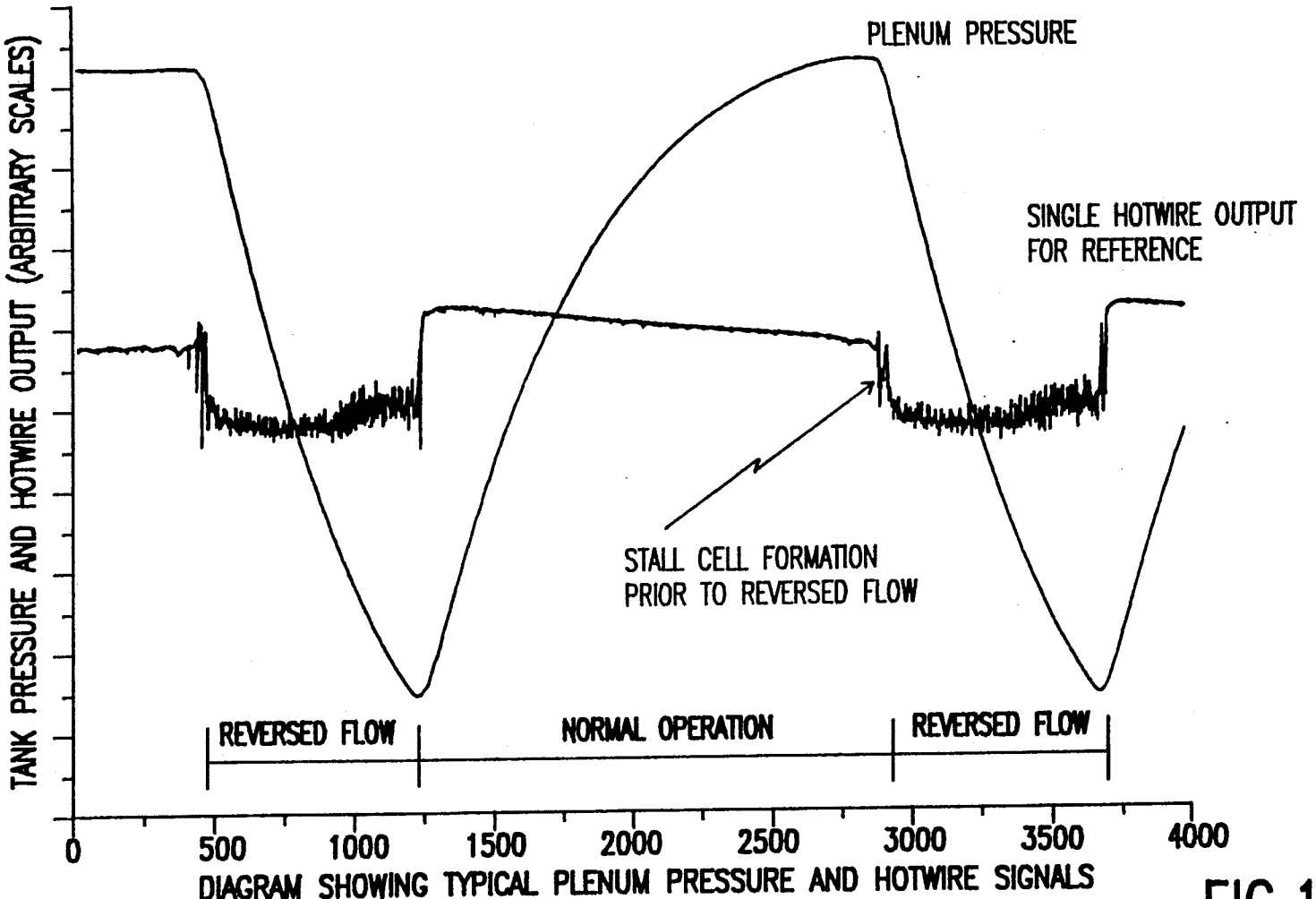
Figure 11:
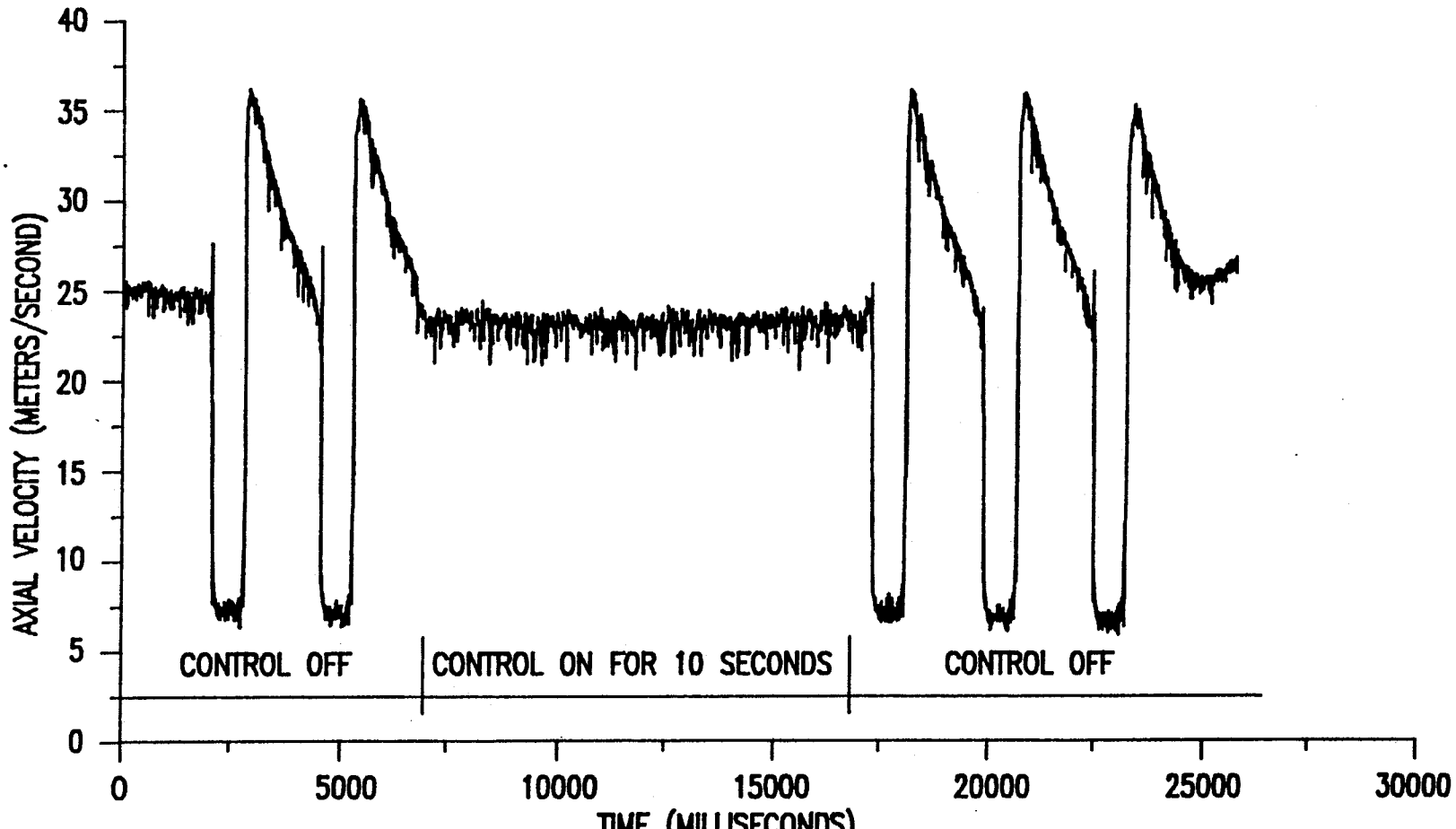
Figure 12:
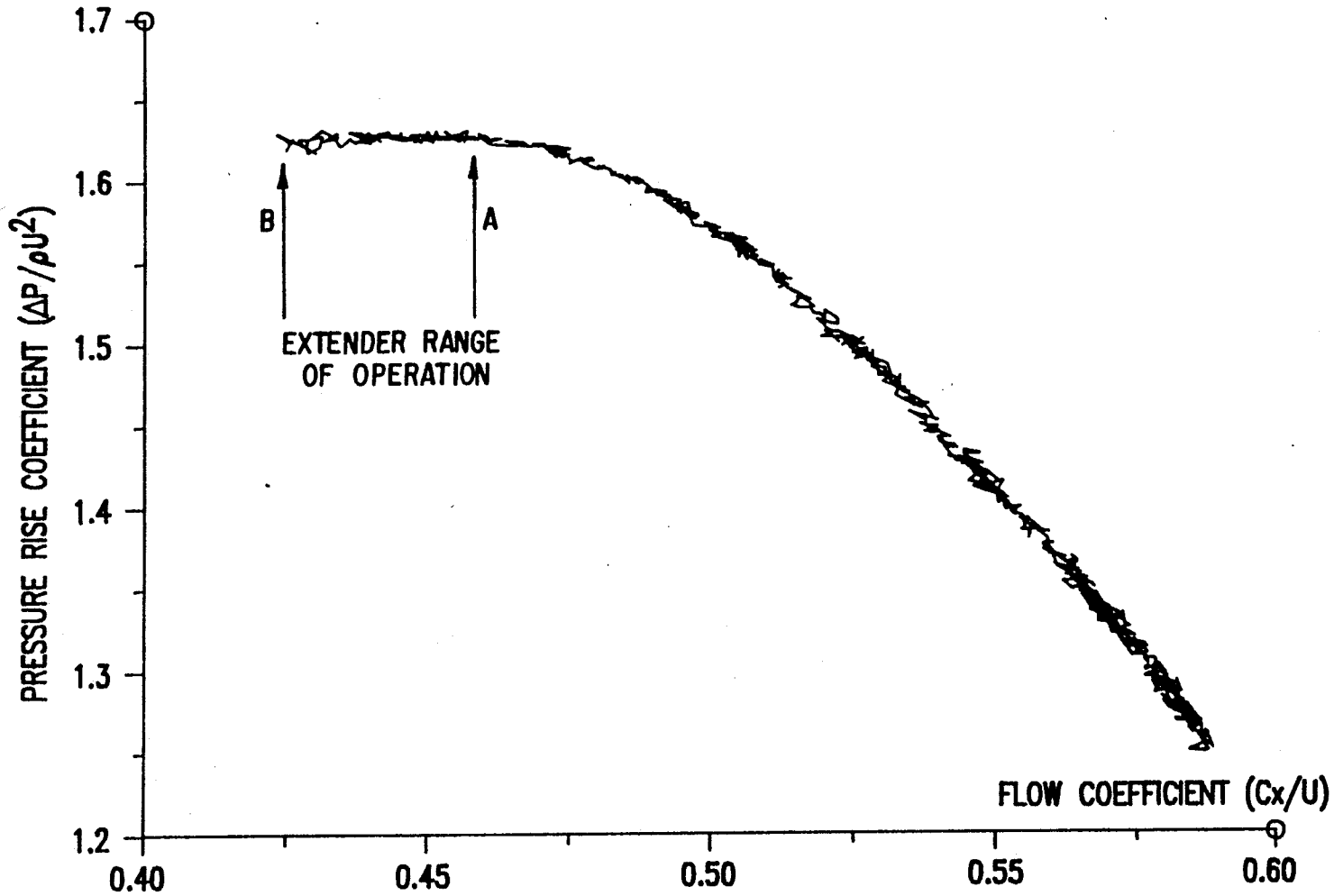
Figure 13B:
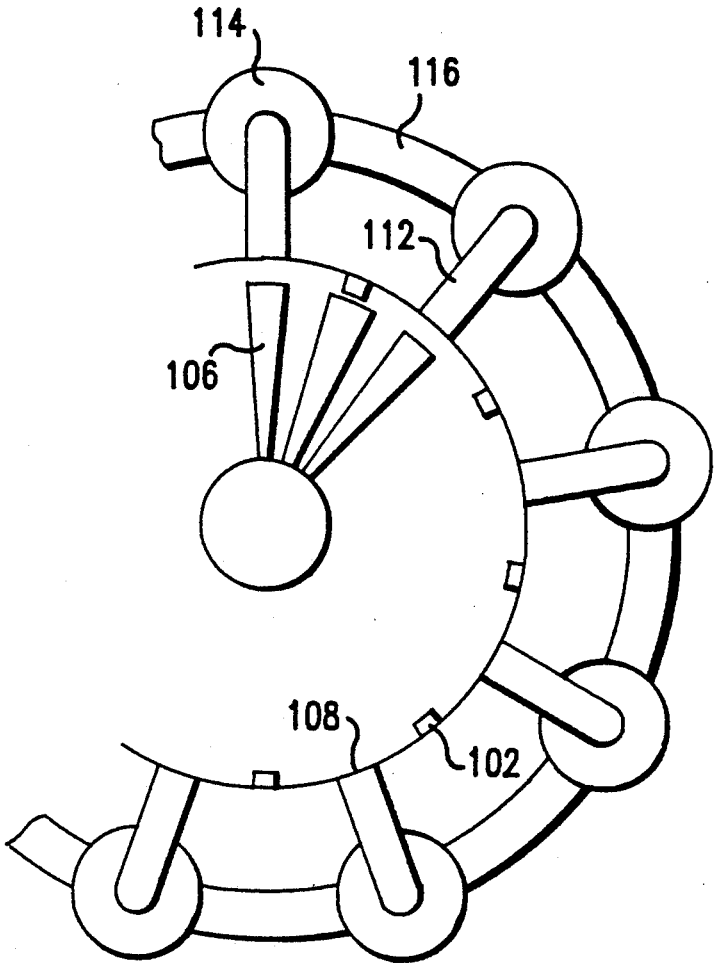
Figure 14:
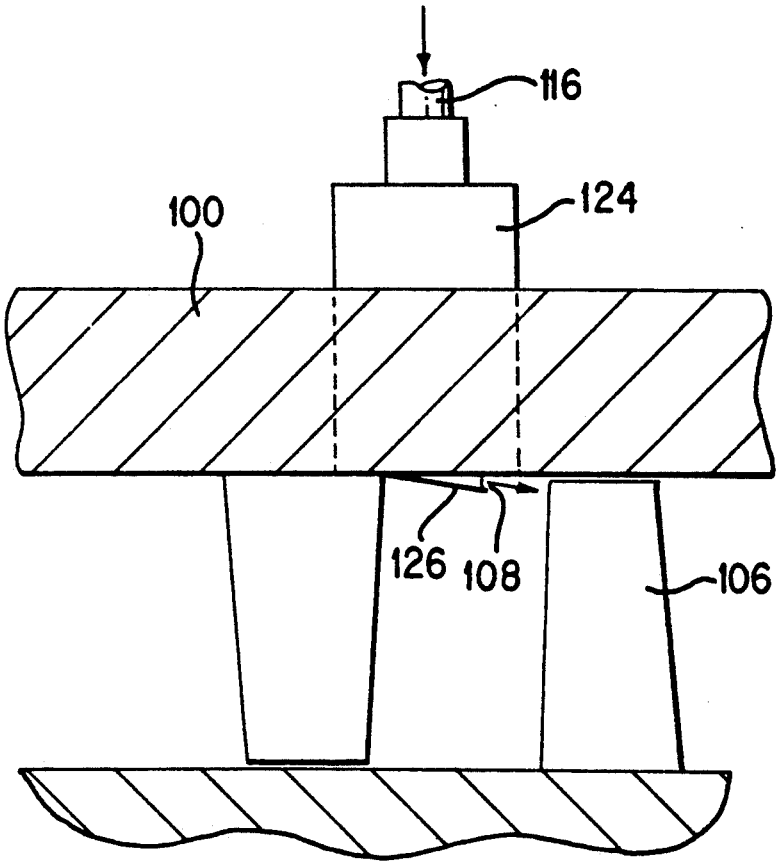

Reference will be made to the accompanying drawings for a fuller description of the invention. In the drawings:

FIGS. 1 to 3 are plots of a series of simultaneous air flow measurements from circumferentially spaced sensors at the entry end of an axial flow air compressor, FIG. 4 is a schematic illustration of the air compressor provided with flow control means according to the invention, FIGS. 5 to 11 are further plots of air flow measurements in the compressor illustrating the operation of the flow control means, FIG. 12 is a graph of the compressor characteristic indicating the improvement of performance obtainable by the use of the control means, FIG. 13A is a schematic illustration of an axial flow jet engine provided with control means according to the invention, FIG. 13B is a partial schematic illustration of a front view of the axial flow jet engine shown in FIG. 13A, FIG. 14 illustrates schematically an alternative air injection means, and FIGS. 15 and 16 are block diagrams illustrating details of the control arrangement in FIG. 13.

Observations indicate that a stall cell in an axial flow compressor can grow from an undetectable disturbance to a fully developed blockage in a matter of milliseconds; this development will usually take place over about 4 revolutions of the compressor rotor. The stall cell may make its first appearance at any point around the flow passage through the compressor, so that a series of spaced sensors are needed to detect the origin and development of a stall cell. Experiments testing the basis of the present invention were made using a turbo-compressor with a series of hot-wire sensors spaced circumferentially around an axial position immediately ahead of the first rotor disc as shown in FIG. 4 (in fact, less than half a blade chord upstream of the rotor disc) and located radially inwards from the outer casing by about one third of the radial depth of the flow passage. In the series of experiments shown in FIGS. 1 to 3 and FIGS. 5 to 11, simultaneous traces are plotted from a series of sensors at equal circumferential spacings.

In FIG. 1, where the outputs from six hot-wire sensors I–VI are shown, the flow into the compressor is initially in a steady state with a very low level of disturbance. An emerging stall cell can first be seen as a small v-shaped disturbance in trace III, which grows progressively as it passes each successive sensor. By the end of its third cycle the stall cell is a fully developed disturbance rotating steadily around the annular passage.

FIG. 2 illustrates to the same time scale as FIG. 1 the initiation of a surge cycle, the first sign of which is the v-shaped stall cell emerging first in trace IV. The subsequent development after a couple of revolutions is notably different from the development of rotating stall, and the outputs from all the sensors show a concurrent and relatively long-lived drop of flow rate. FIG. 2 shows the first part of the surge cycle. FIG. 3 shows, over a longer time scale, the complete "stall-backflow-refill" sequence. Steady flow, dropping slightly as the back pressure builds up, finally breaks down and the flow reverses, steady flow being resumed again at a higher rate because of the reduced back pressure. A significant point to note from these results is that both stall and surge begin with the formation of a small, sharply defined patch of stalled flow. This is despite the fact that, as a system related phenomenon, surge might be expected to develop as some form of "volume and duct" instability.

Another point to note in connection with these results is that recent theoretical work (Moor RK, and Greitzer EM, "A Theory of Post-Stall Transients in Axial Compressors: Part I—Development of the Equations", ASME *Journal of Engineering for Gas Turbine and Power*, Vol 108, pp 68–76, January 1986 and Greitzer EM, and Moore FK, "A Theory of Post-Stall Transients in Axial Compressors: Part II—Applications", ASME *Journal of Engineering for Gas Turbine and Power*, Vol 108, pp 231–239, January 1986) suggests that the formation of the finite stall cell is preceded by a circumferential disturbance of the incoming flow, so called "pre-stall waves". These waves, although small in amplitude, can often be detected in the compressor flow, but the detailed measurements taken during our investigation have failed to find any support for a cause and effect relationship between such "pre-stall waves" and the v-shaped disturbances that lead to a performance drop. The same sharply defined stall cell is found regardless of whether or not the pre-stall wave is present. Moreover, when preceded by a wave, once it has formed the cell will begin to rotate at a speed totally different from that of the preceding wave. It appears, therefore, that the initiation of the first v-shaped disturbance is the only reliable indicator that the compressor flow is about to destabilize.

FIG. 4 illustrates in outline the axial flow compressor C equipped with flow control means in accordance with the invention. The hot wire sensors 2 can be seen immediately between a ring of fixed inlet guide vanes 4 and the first stage 6 of rotor blades. At the same axial position but circumferentially spaced from the sensors there are air inlets 8 blending tangentially with the inner wall 10 of the compressor casing. The inlets are directed rearwards into the adjacent rotor blade ring. The inlets are set at an angle in the circumferential sense that directs them counter to the direction of rotation of the rotor. The angle may be varied quite widely but it preferably lies between the axial direction and an angle to that direction substantially equal to the stagger angle of the rotor blades of the adjacent ring. The inlets 8 are connected by conduits 12 through respective rotary shut-off valves 14, to a ring main 16. A series of conduits 18 leading from a number of tappings 20 equispaced around the circumference of the high-pressure end of the compressor feed the ring main 16 with a high-pressure air supply.

The valves 14 are normally shut but can be opened by a control circuit 22 in dependence upon the signals from the sensors 4. As will be described in more detail below, detection of a disturbance by some or all of the sensors greater than the anticipated level of noise in the steady flow at the compressor inlet triggers the opening of the valves 14 to inject onto the first ring of rotor blades the high pressure flow bled from the outlet end of the compressor.

Figure 5:
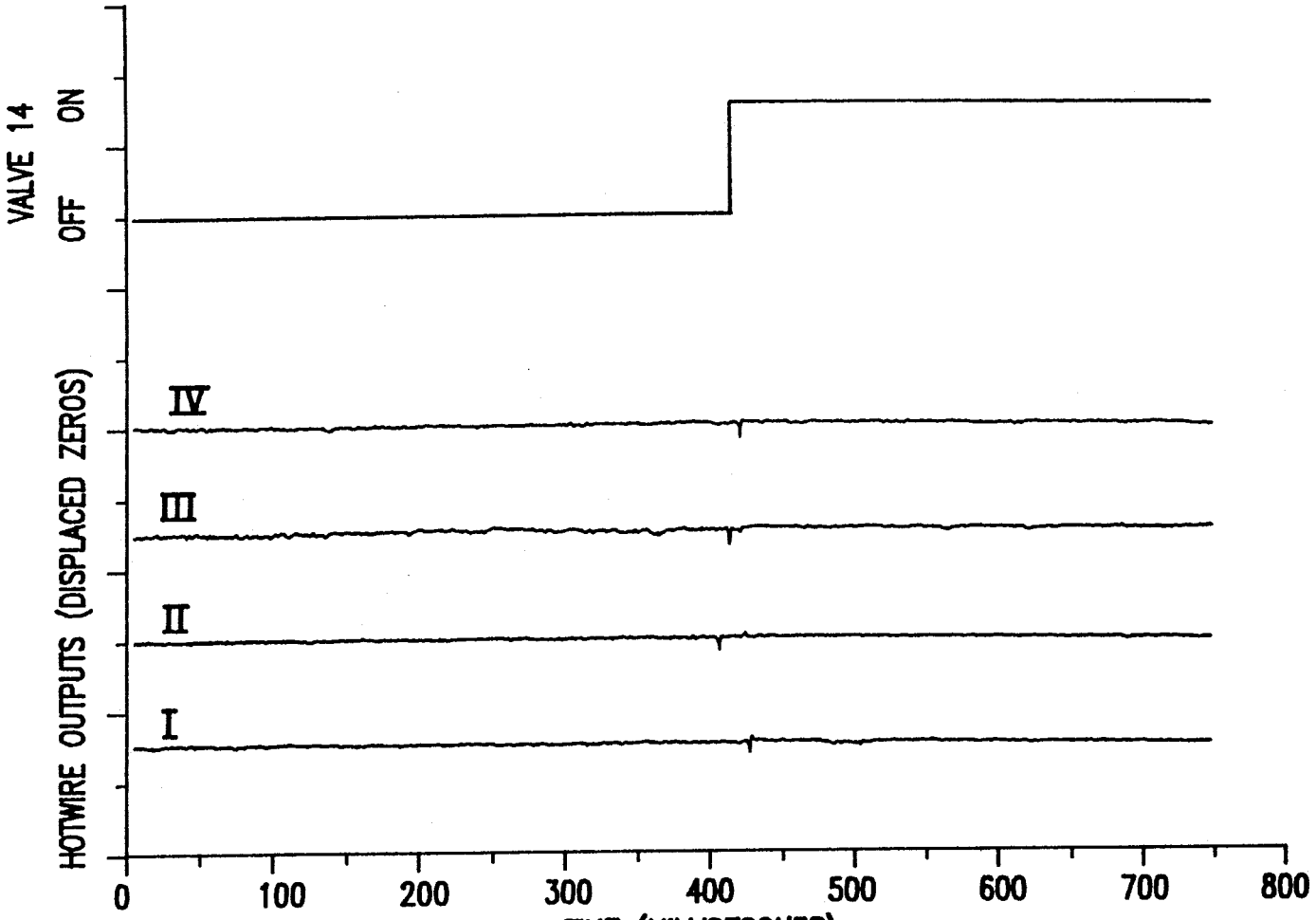

In FIG. 5 the outputs from a series of four equispaced sensors are shown, with a stall cell appearing first in the trace of sensor II. As the stall cell circulates past sensors III and IV, the control circuit 22 is able to confirm that the disturbance is not an instrument fault and the output from the control circuit is turned on to open the valves 14. FIG. 5 demonstrates how the injection of high pressure air immediately suppresses the stall cell.

Figure 6:
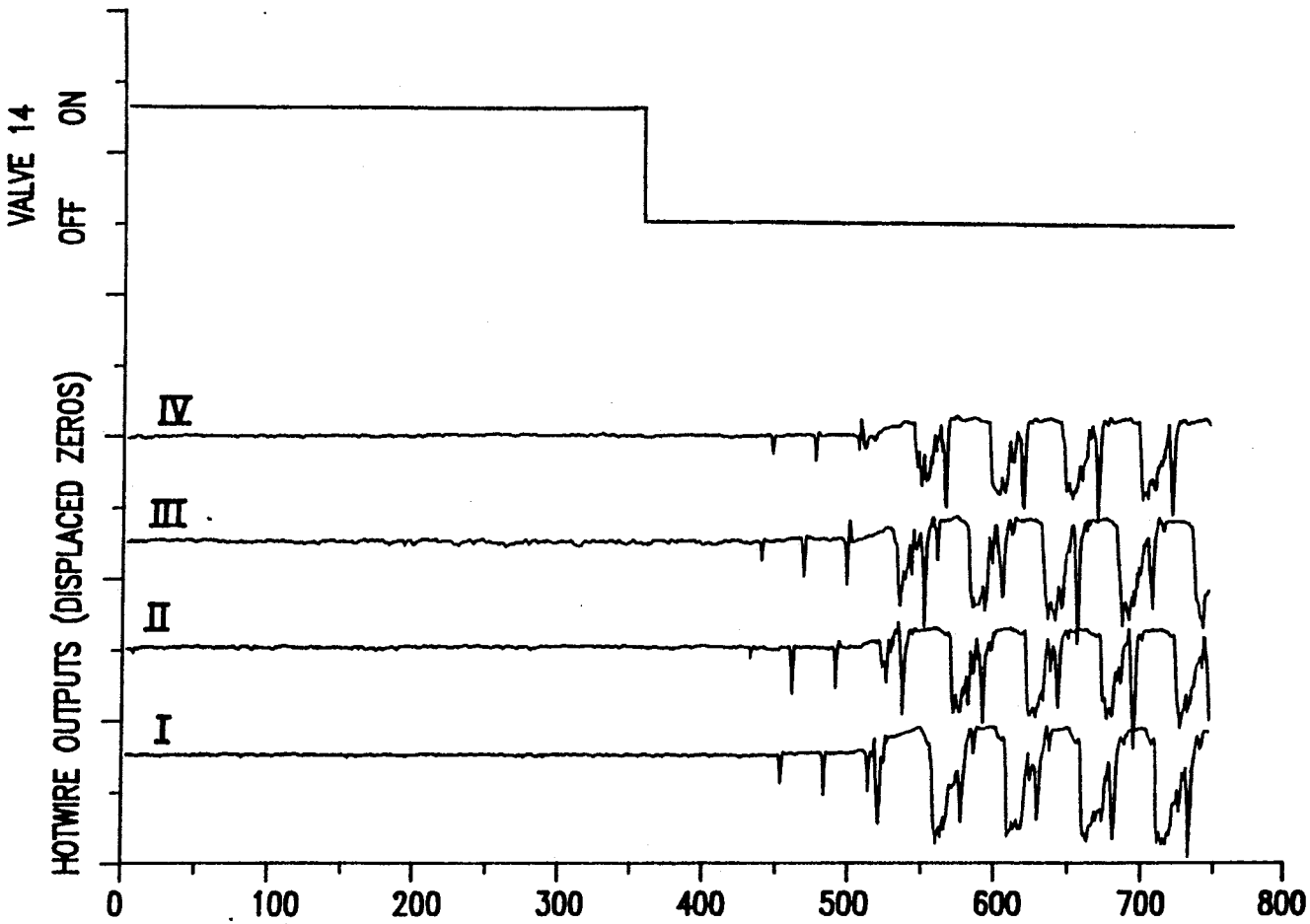

FIG. 6 illustrates the same set-up in which, conversely, overriding the control unit and switching the valve 14 closed allows the stall cell to reappear and a fully developed rotating stall condition quickly establishes itself.

To economise on the use of high pressure air, the control unit 22 should close the valves once the stall cell has been suppressed. The use of a timer to switch the valves off is illustrated in an experiment that produced the traces shown in FIG. 7. The steady flow is close enough to a critical condition for a stall cell to appear after a short time with the valves closed, but on each occasion when the control system is operative, the disturbance is quickly removed. As indicated in FIG. 7, the control system was switched off after demonstrating its efficiency, whereupon the next re-emergence of the stall cell led to a rotating stall condition.

Figure 7:
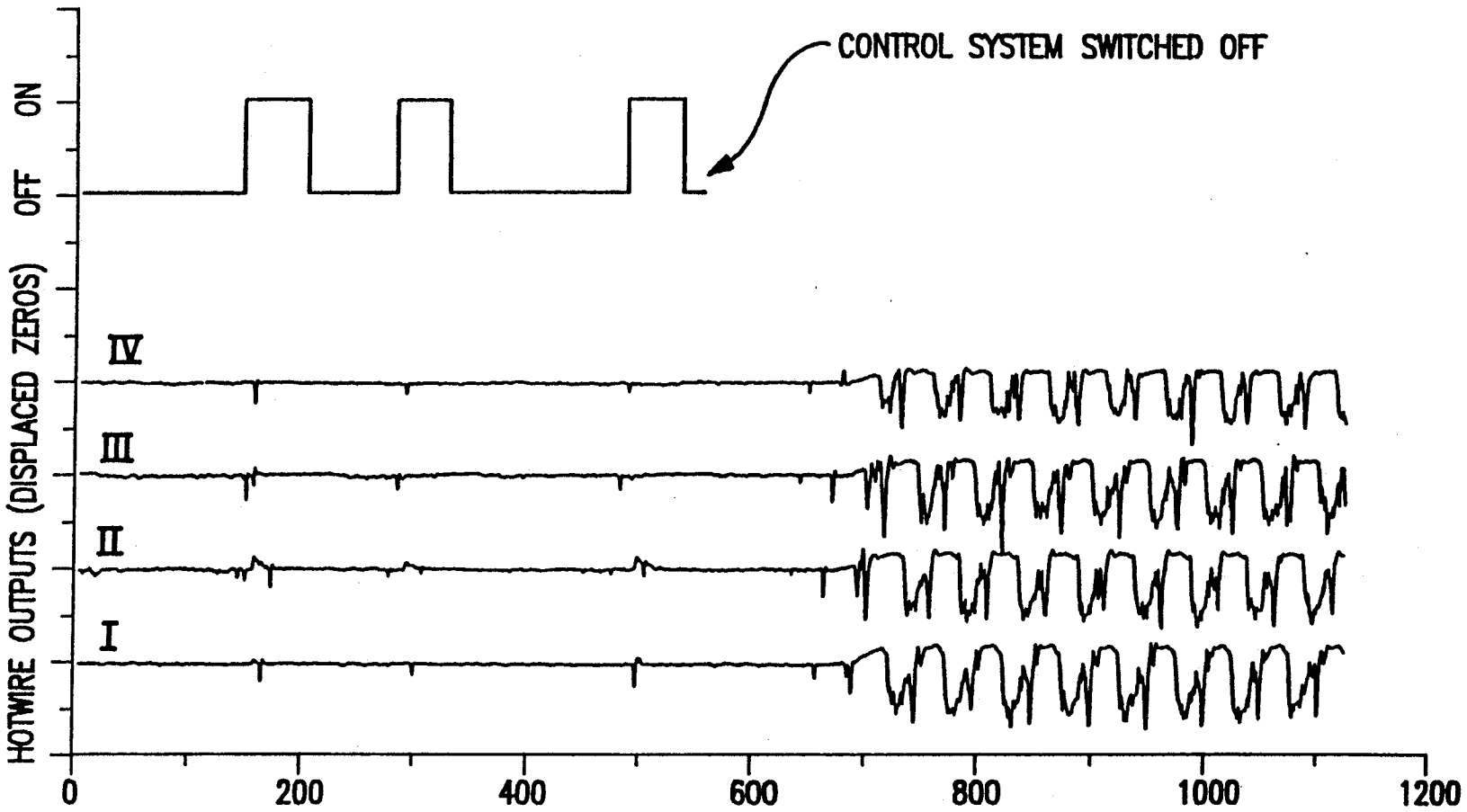
Figure 8:
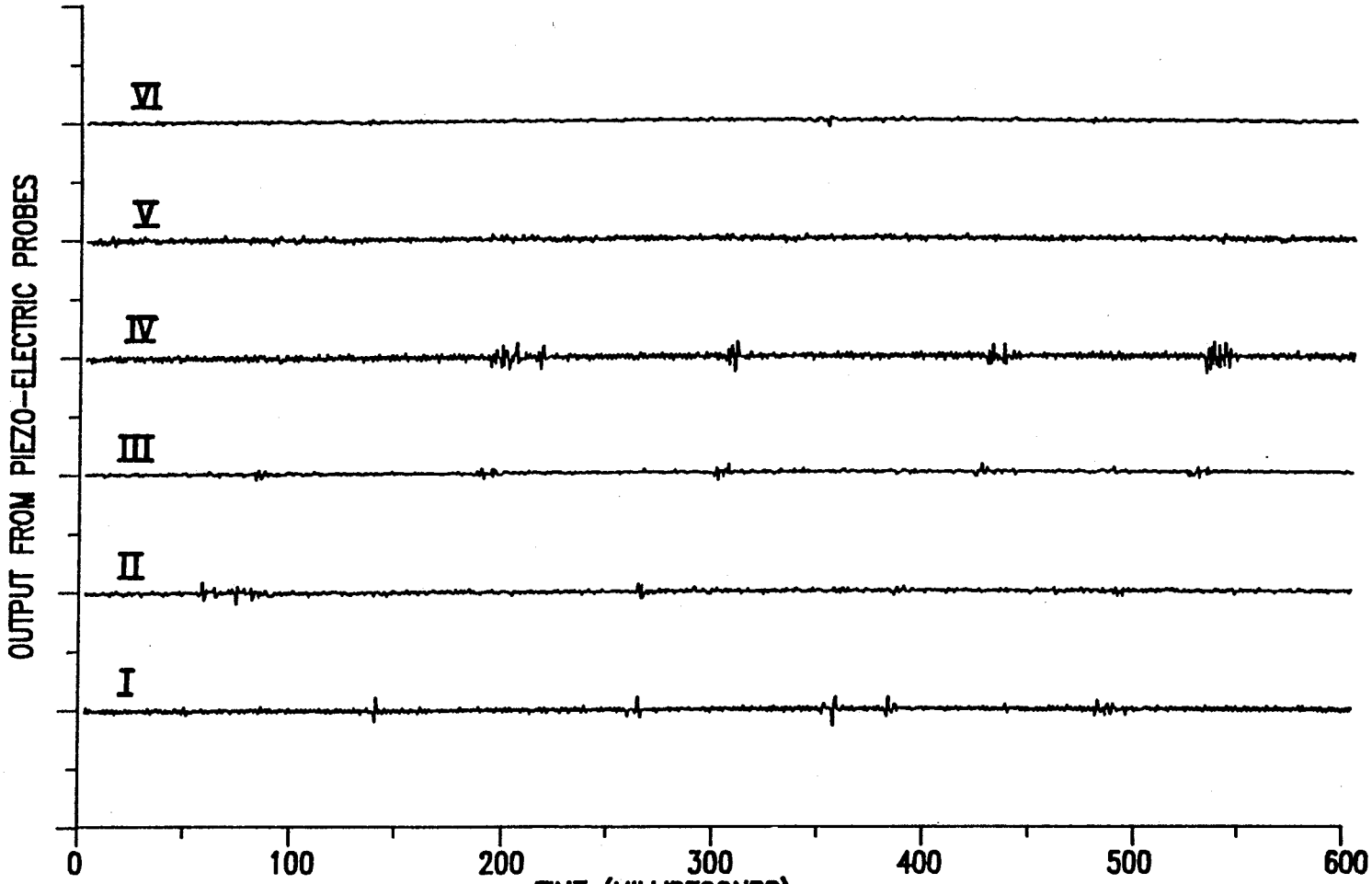

FIGS. 8 and 9 show a similar experiment to that in FIG. 7, here using piezo-electric sensors, which are able to actuate the opening of the individual injection valves each operatively linked with a circumferentially adjacent sensor to inject high pressure air through the inlets 8.

FIG. 8 demonstrates how the disturbance is suppressed each time that an incipient stall cell is detected. FIG. 9 shows the opening and closing sequence of the control valves. It may be noted from incidents in traces II and IV, that it is possible to arrange for the control unit to respond to a persistent disturbance sufficiently fast to effectively extend the period of valve opening.

In FIG. 10 there is an illustration of the sensor traces recorded during a typical surge cycle in which the compressor of FIG. 4 delivers its output to a tank to produce a progressive pressure increase at the compressor outlet. After the initial disturbance of the steady state flow with stalling of the compressor, a reverse flow from the tank allows the exit pressure to fall until normal steady state flow was resumed, the cycle being repeated as the tank pressure rises to a critical level.

In FIG. 11, the same surge cycle is shown, to a compressed time scale, in which the control system was switched on for a period in the middle of the cycle. As will be clear, the surge cycle was suppressed by the operation of the injection valves and reappeared when the control system was switched off.

FIG. 12 illustrates a typical pressure rise characteristic of an axial flow compressor. Without the use of the present invention, instability and a drastic drop in performance would be met at the point on the characteristic indicated by the arrow A. With the use of the invention, the characteristic extends to the point indicated by the arrow B before breakdown occurs. Since in actual performance it is necessary to operate with a significant safety margin because of the catastrophic consequences of breakdown, the extension of the range of operation offered by the use of the invention is able to yield a substantial improvement in performance.

FIG. 13 illustrates schematically the application of control apparatus according to the invention to a gas turbine which comprises an axial flow compressor A, combustion chamber C and turbine T, the compressor and turbine being coupled by a coaxial shaft S to rotate together. Sensors 102, which can be hot-wire sensors, are mounted immediately upstream of each stage of blades of the compressor spool, although illustrated only in front of the first stage of blades 106. At each such position there is a series of sensors 102 circumferentially equally spaced around the casing. Immediately upstream of each stage of blades also is a series of air inlet ports 108 connected by conduits 112 with valves 114 to a ring main 116 fed with high pressure air through conduits 118 from the plenum region at entry to the combustion chamber C. FIG. 14 illustrates in more detail the air injection arrangement at a typical port 108, with the valve 114 comprising a body 124 mounted in the casing wall 100 and a hinged closure flap 126 for the outlet 108. The normally closed valves can be opened by control circuit 122, when the circuit is triggered by the sensor outputs, to allow air to be injected at a pressure higher than the local pressure. The ring main 116 can be arranged to provide a reservoir for a significant mass of high-pressure air so that the pressure injection into the compressor flow is virtually instantaneous. It may be appropriate, in fact, for the ring main to act as an accumulator to provide all or substantially all the injection flow during the opening cycle of the valves. The injection pressure will thus fall during the injection pulse and the ring main pressure will be restored by the flow through the conduits 118 after the valves have closed.

The ports 108 direct their flows downstream and at an inclination in the manner of the inlets 8 of FIG. 4. They are spaced circumferentially from adjacent hot-wire sensors 102 so as not to influence the sensor outputs. The number of sensors deployed will depend upon the speed of response demanded; in most installations at least six sensors will be required. There will be at least the same number of outlet ports if they are to be opened sequentially in dependence on the sensor outputs.

If similar means for air injection are provided at a number of axial stations, the circumferentially corresponding injection conduits 112 at two or more stations may share the same control valve 114. If injection is required only to counter incipient surge conditions, a circumferential series of injection conduits may be connected to a common control valve 114.

An example of that part of the control circuit dealing with an individual sensor output is shown in more detail in FIG. 15. The electronic signal a from each sensor output is first filtered in a low-pass filter 130 to remove blade order disturbances and the filtered signal b is then processed in an integrator 132 to give an average sensor value C over a rolling period equal to about two rotations of the compressor. The average value thus gives a steady but continuously updated base level against which the magnitude of instantaneous variations can be measured.

The integrated output C is compared with the filtered instantaneous signal b in a subtraction unit 134, the difference d between the two signals being the perturbation, i.e. the divergence of the instantaneous signal from the rolling average. By dividing the perturbation d by the average value C in circuit 136, a non-dimensional measure e of the deviation is obtained. The output e from the divider circuit 136 is fed to a discriminator 138 to be compared with a pre-set level X which must at least be matched if the air injection is to be operated. The output f from the discriminator is on if the magnitude of the division is greater than or equal to X. The pre-set perturbation operation level X is chosen to be greater than the value that would appear in normal engine operating conditions such as acceleration and deceleration, but is less than the level that would appear in a stall condition.

The processing of the outputs f derived from individual sensor signals is now combined in the circuit shown in FIG. 16. In this circuit a store 142 has addresses for the outputs from all of the sensors of each stage. When an output $f(e>X)$ occurs, that signal is held, e.g. for two revolutions of the compressor. The values held in the store are extracted to be summed, in an addition circuit 144 for all of the sensors in a given compressor stage, and in an addition circuit 146 for the sensors of different stages but similar circumferential positions. Respective comparators 148,150 determine if the summed signals exceed predetermined values, whereupon a valve control circuit 152 is actuated to open the injection valve or valves 114 to the appropriate compressor locations. Simultaneously, a timer 154 is actuated to close the valves 114 again after a set period, which may correspond to as little as one or two revolutions of the compressor.

It will be noted that, in contrast to an active control system, there is no linear feedback control in the system described. Because of this the control system can be considerably simplified. Detection of a disturbance exceeding a predetermined level produces a fixed response (with the possibility of discrete forms of response being available for different forms of disturbances). It is found that it is possible to take effective action even though this process requires a perturbation to become finite before the response is initiated. If the disturbance persists the system can simply actuate a further fixed response.

The method of control according to the invention can also operate to counter a steady flow distortion, i.e. some element of circumferential asymmetry in the flow which, although not necessarily leading to a catastrophic disruption of the flow, reduces the efficiency of the turbo-compressor. For this purpose, the control systems would be arranged to act on the appropriate single injection valves or selected groups of the valves at a particular station when a steady flow distortion is indicated by the signals sensed.

It is possible to employ the collected data for further control functions. If the rolling average of the sensor outputs for any one stage of the compressor are added and the rolling average for each individual sensor is subtracted, a measure of circumferential steady distortion of the air flow is obtained. If a number of transducers in substantially the same line of flow through the compressor show a difference of sufficient magnitude from the average of their respective stages, the valve or valves associated with that flow line can be opened to reduce or prevent such steady state distortion. This can prevent distortion of the intake flow inducing surge prematurely. Essentially the only addition required to perform this function is an extension of the logic algorithm of the circuit of FIG. 16 to compare the time average of each sensor input with the space and time average of its stage.

The injection of air to inhibit stall and surge conditions should be controlled in such a way as to minimise any loss of efficiency. For example, instead of opening an injection valve fully when an instability is detected, the amount of opening may be graduated, or the injected flow volume may be reduced if the valve is opened and closed several times in quick succession. In the case of a graduated opening, it may be arranged that, if there is a further command from the logic circuitry to open the valve once the valve is partly open, e.g. 25%, then the valve is opened wider, so that detection of an unstable condition will not excite an excessive response with the resulting loss of engine efficiency.

The form of response may also be matched to the type of instability being detected. In the case of rotating stall, the distortion will circulate around the circumference of any particular stage and if the distortion is sensed in sequence by the associated sensors, it may not be necessary to inject pressure air through all the inlets associated with that stage. A sequential injection in phase with the distortion may then be sufficient. That does not apply if the distortion is sensed simultaneously by all the sensors, indicating a surge condition.

The speed of response of the system is dependent upon the level of discrimination, which must be sufficiently low to enable corrective action to be initiated before any significant loss of engine power occurs, yet must not be so sensitive as to respond to the normal and inevitable variations that occur in the operation of an axial flow compressor, such as the blade to blade differences and the wake disturbances of each blade giving a blade passing frequency variation. This latter is usually the most significant component in the axial flow compressor of an aero engine and would give a variation there of about 2%. The limiting value for initiating corrective action, i.e. the value of X for the discriminators 138, would thus be set above the 2% level in such an installation.

Although the invention has been described in relation to axial compressors, it is also applicable to the control of disturbances such as surge in centrifugal compressors.

Whereas the signal processing elements of the above embodiments of the invention have been described in connection with FIGS. 15 and 16 as discrete components or blocks in electronic circuits, it should be understood that the invention is not so limited and embraces such signal processing when carried out as program steps in a digital computer, a microprocessor-based control unit being the preferred option.

We claim:

1. A method of controlling gas flow in a turbo-compressor having an inlet and an exit, in which the flow is sensed at a series of circumferentially spaced positions at a chosen axial station in the direction of flow through the compressor to detect a flow variation associated with at least one sharply defined patch of stalled flow giving a short duration sensor signal passing transiently through a predetermined level and, upon such variation being detected, a flow of higher-pressure gas is injected into the compressor generally in said direction of flow, to act against flow disturbances indicated by said at least one flow variation.

2. A method according to claim 1 wherein flow variations are sensed at a plurality of stations spaced from each other in the flow direction and said injection of high-pressure gas is actuated at each said station in response to said detection of said variations at said station.

3. A method according to claim 1 wherein the flow of higher pressure gas is shut off after a predetermined time.

4. A method according to claim 1 wherein said flow variation is more than about 2% of the mean flow value sensed.

5. A method of controlling gas flow in a turbo-compressor in which the flow is sensed at a series of circumferentially spaced positions at a chosen axial station in the direction of flow through the compressor to detect a flow variation associated with at least one sharply defined patch of stalled flow giving a short duration sensor signal passing transiently through a predetermined level, and in which the sensing of said variation at a series of said position in circumferential sequence actuates an injection of a flow of gas at a higher pressure than that prevailing at said station to act against a flow disturbance indicated by said variations, said flow of gas at a higher pressure being injected generally in said direction of flow.

6. A method of controlling gas flow in a turbo-compressor having an inlet and an exit, in which the flow is sensed at a series of circumferentially spaced positions at a chosen axial station in the direction of flow through the compressor to detect a flow variation associated with at least one sharply defined patch of stalled flow and, upon such variation being detected, a flow of higher-pressure gas is injected into the compressor generally in said direction of flow, to act against flow disturbances indicated by said at least one flow variation; wherein the flow of higher pressure gas is tapered off after its initiation.

7. A method of controlling gas flow in a turbo-compressor having an inlet and an exit, in which the flow is sensed at a series of circumferentially spaced positions at a chosen axial station in the direction of flow through the compressor to detect a flow variation associated with at least one sharply defined patch of stalled flow and, upon such variation being detected, a flow of higher-pressure gas is injected into the compressor generally in said direction of flow, to act against flow disturbances indicated by said at least one flow variation; wherein a sensed signal of said variation at each said spaced position at the station is averaged over a rolling period corresponding to not substantially less than two revolutions of the compressor to give a mean signal value, a difference signal is formed between an instantaneous sensed signal and the mean signal value, a measure of a relative magnitude of the difference signal is obtained, and detection of the relative magnitude of the difference signal above a predetermined level from each of a plurality of the sensing positions is arranged to produce an operative output for actuating the flow of higher pressure gas.

8. A method of controlling gas flow in a turbo-compressor having an inlet and an exit, in which the flow is sensed at a series of circumferentially spaced positions at a chosen axial station in the direction of flow through the compressor to detect a flow variation associated with at least one sharply defined patch of stalled flow and, upon such variation being detected, a flow of higher-pressure gas is injected into the compressor generally in said direction of flow, to act against flow disturbances indicated by said at least one flow variation; wherein the actuation of the pressure injection flow is arranged to operate on sensing sequentially, at some of said circumferentially spaced positions of the station, a flow variation.

9. A method of controlling gas flow in a turbo-compressor having an inlet and an exit, in which the flow is sensed at a series of circumferentially spaced positions at a chosen axial station in the direction of flow through the compressor to detect a flow variation associated with at least one sharply defined patch of stalled flow and, upon such variation being detected, a flow of higher-pressure gas in injected into the compressor generally in said direction of flow, to act against flow disturbances indicated by said at least one flow variation; wherein the turbo-compressor has a rotating compressor rotor and wherein said direction of injection flow of higher pressure gas has a direction of flow with a component in opposition to the direction of rotation of the compressor rotor.

10. Apparatus for controlling gas flow in a turbo-compressor having an inlet and an exit comprising: means for sensing a flow variation associated with at least one sharply defined patch of stalled flow giving a short duration sensor signal passing transiently through a predetermined level, at a series of circumferentially spaced positions at a chosen axial station in the direction of flow through the compressor; means for injecting high pressure gas into the compressor, generally in said direction of flow; and control means for permitting said injection to take place, said control means being operable by said detection means upon detection of said flow variations.

11. Apparatus according to claim 10 comprising means for reducing or stopping said injection flow in a predetermined manner.

12. Apparatus according to claim 10 wherein the flow control means is biased to a normally closed position.

13. Apparatus for controlling gas flow in a turbo-compressor comprising: flow sensing means for outputting sensor signals from a series of circumferentially spaced position at a chosen axial station in the direction of flow through the compressor; means for detecting from the sensor signals a flow variation associated with at least one sharply defined patch of stalled flow giving a short duration sensor signal passing transiently through a predetermined level; means for injecting gas at a higher pressure than the pressure prevailing at said station and generally in the direction of gas flow through the turbo-compressor; and means for actuating said injection means in response to sensing said variations at a series of said positions in circumferential sequence thereby to act against a flow disturbance indicated by said variations.

14. Apparatus for controlling gas flow in a turbo-compressor having an inlet and an exit comprising: means for sensing a flow variation associated with at least one sharply defined patch of stalled flow at a series of circumferentially spaced positions at a chosen axial station in the direction of flow through the compressor; means for injecting high pressure gas into the compressor, generally in said direction of flow; and control means for permitting said injection to take place, said control means being operable by said detection means upon detection of said flow variation; wherein said sensing means are provided at a plurality of stations spaced from each other in the flow direction and said injection means are provided at each said station, the control means being arranged to initiate said injection flow at a respective station in response to the detection of said flow variation at said station.

15. Apparatus for controlling gas flow in a turbo-compressor having an inlet and an exit comprising: means for sensing a flow variation associated with at least one sharply defined patch of stalled flow at a series of circumferentially spaced positions at a chosen axial station in the direction of flow through the compressor; means for injecting high pressure gas into the compressor, generally in said direction of flow; and control means for permitting said injection to take place, said control means being operable by said detection means upon detection of said flow variation; wherein the control means comprises means for averaging the signal sensed at each said spaced position over a rolling period to produce a means signal value, means for forming a difference signal between an instantaneous sensed signal and the mean signal value, means for measuring a relative magnitude of said difference signal and output means for producing an actuating signal for controlling the flow of high pressure gas upon detection of a relative magnitude of the difference signal above a predetermined level from each of a plurality of the sensing positions.

16. A method of controlling gas flow in a turbo-compressor having an inlet and an exit, in which the flow is sensed at a series of circumferentially spaced positions at a chosen axial station in the direction of flow through the compressor to detect variations in the flow above a predetermined variation limit and, upon such variation being detected, a flow of higher-pressure gas is injected into the compressor generally in said direction of flow, upon such a variation being detected, to act against flow disturbances indicated by said variations, wherein the actuation of the pressure injection flow is arranged to operate on sensing sequentially, at some of said circumferentially spaced positions of said station, a flow variation above the predetermined limit.

17. Apparatus for controlling gas flow in a turbo-compressor having an inlet and an exit comprising: means for sensing variations in the flow at a series of circumferentially spaced positions at a chosen axial station in the direction of flow through the compressor; means for injecting high pressure gas into the compressor generally in said direction of flow; and control means for permitting said injection to take place, said control means being operable by said detection means upon detection of said flow variations above a predetermined variation limit; and wherein said sensing means are provided at a plurality of stations spaced from each other in the flow direction and said injection means are provided at each said station, the control means being arranged to initiate said injection flow at a respective station in response to the detection of said flow variations at said station.

18. Apparatus for controlling gas flow in a turbo-compressor comprising: flow sensing means for outputting sensor signals from a series of circumferentially spaced positions at a chosen axial station in the direction of flow through the compressor; means for detecting from the sensor signals flow variations above a predetermined variation limit; means for injecting gas at a higher pressure than the pressure prevailing at said station and generally in the direction of gas flow through the turbo-compressor; and means for actuating said injection means in response to sensing said variations; at a series of said positions in circumferential sequence thereby to act against a flow disturbance indicated by said variations; and wherein said sensing means are provided at a plurality of stations spaced from each other in the flow direction and said injection means are provided at each said station, the control means being arranged to initiate said injection flow at a respective station in response to the detection of said flow variations at said station.

* * * * *